US008973388B2

(12) United States Patent
Hayashi

(10) Patent No.: US 8,973,388 B2
(45) **Date of Patent: *Mar. 10, 2015**

(54) DUCT TYPE AIR CONDITIONER

(75) Inventor: Yusuke Hayashi, Kawasaki (JP)

(73) Assignee: Fujitsu General Limited, Kawasaki-shi (JP)

( * ) Notice: Subject to any disclaimer, the term of this patent is extended or adjusted under 35 U.S.C. 154(b) by 622 days.

This patent is subject to a terminal disclaimer.

(21) Appl. No.: 12/902,256

(22) Filed: Oct. 12, 2010

(65) Prior Publication Data

US 2011/0138846 A1 Jun. 16, 2011

(30) Foreign Application Priority Data

Dec. 11, 2009 (JP) ..... 2009-281458

(51) Int. Cl.

| | |
|---|---|
| ***F25D 23/12*** | (2006.01) |
| ***F24F 1/00*** | (2011.01) |
| ***F04D 29/42*** | (2006.01) |
| ***F04D 29/60*** | (2006.01) |
| ***F04D 29/62*** | (2006.01) |
| ***F24F 13/20*** | (2006.01) |

(52) U.S. Cl.

CPC ..... *F24F 1/0007* (2013.01); *F04D 29/4206* (2013.01); *F04D 29/601* (2013.01); *F04D 29/626* (2013.01); *F24F 13/20* (2013.01); *F24F 1/0033* (2013.01)

USPC ..... 62/259.1; 62/314; 62/414

(58) Field of Classification Search

CPC . F04D 29/4206; F04D 29/601; F04D 29/626; F24F 1/0007; F24F 1/0033; F24F 13/20

USPC ..... 62/259.1, 314, 414; 165/127; 415/101, 415/102, 60–61

See application file for complete search history.

(56) References Cited

U.S. PATENT DOCUMENTS 4,449,376 A * 5/1984 Draper et al. ..... 62/259.1
6,082,131 A * 7/2000 Hirosawa et al. ..... 62/448

(Continued)

FOREIGN PATENT DOCUMENTS

CN 1847735 A 10/2006
JP S61-29223 U 2/1986

(Continued)

OTHER PUBLICATIONS

Jim Bryan, Reversing the Direction of Rotation of TEFC Motors, US Motors / Emerson Motor Technologies, Product Service Bulletin, vol. 12 (Jan. 2004).*

(Continued)

*Primary Examiner* — Mohammad M Ali
(74) *Attorney, Agent, or Firm* — Locke Lord LLP

(57) ABSTRACT

Even in the case of drop accident occurring due to a certain cause during transport or the like, it is intended by the present invention that any deformation of a motor support or a fan panel will not occur. A fan mechanism includes fan units having fan panels disposed vertically, motor supports mounted inwardly of said fan panels, motors mounted on said motor supports so that output shafts of the motors are parallel to the surfaces of the fan panels, fans positioned inwardly of said fan panels and driven by the motors, and spacers mounted to the motor supports so as to be positioned between the motor supports and a top plate or a bottom plate that serves as a bottom during conveyance.

8 Claims, 7 Drawing Sheets

(56) References Cited

U.S. PATENT DOCUMENTS

| | | | | |
|---|---|---|---|---|
| 6,997,005 | B2 * | 2/2006 | Haasis | 62/258 |
| 8,096,137 | B2 * | 1/2012 | Czerwonky et al. | 62/259.1 |

FOREIGN PATENT DOCUMENTS

| | | | | |
|---|---|---|---|---|
| JP | 62299637 | A | * | 12/1987 |
| JP | H02-34799 | U | | 3/1990 |
| JP | H02-34800 | U | | 3/1990 |
| JP | 04006341 | A | * | 1/1992 |
| JP | H04-6341 | A | | 1/1992 |
| JP | H07-26612 | U | | 5/1995 |
| JP | H08-94108 | A | | 4/1996 |
| JP | 2001227768 | A | * | 8/2001 |
| JP | 2001227770 | A | * | 8/2001 |
| JP | 2008075928 | A | * | 4/2008 |
| KR | 2000033827 | A | * | 6/2000 |
| KR | 2005064963 | A | * | 6/2005 |
| KR | 2009115278 | A | * | 11/2009 |
| WO | WO-2006080793 | A2 | | 8/2006 |
| WO | WO 2006080793 | A2 | * | 8/2006 |

OTHER PUBLICATIONS

Chinese Office Action dated Jan. 23, 2014 for corresponding Chinese Patent Application No. 201010265966.X.

Chinese Office Action dated Jul. 22, 2014 for corresponding Chinese Patent Application No. 201010265966.X.

Japanese Office Action mailed on Dec. 10, 2013 for corresponding Japanese Patent Application No. 2009-281458.

* cited by examiner

DUCT TYPE AIR CONDITIONER

This application is related to two co-pending applications: "DUCT TYPE AIR CONDITIONER" filed even date herewith in the name of Yusuke Hayashi claiming the right of priority under 35 U.S.C. §119 based on Japanese Patent Application No. 2009-281456; and "DUCT TYPE AIR CONDITIONER" filed even date herewith in the names of Futoshi Yamada and Katsuya Kato claiming the right of priority under 35 U.S.C. §119 based on Japanese Patent Application No. 2009-281457; which applications are assigned to the assignee of the present application and all three incorporated by reference herein.

BACKGROUND OF THE INVENTION

1. Field of the Invention

The present invention relates to a duct type air conditioner in which a fan mechanism is improved.

2. Description of the Prior Art

As for a duct type air conditioner in the prior art, there is a technique to provide a fan mechanism formed by assembling a fan and a motor with a fan panel which is vertically disposed, and the entire fan mechanism is received in a casing by mounting the fan panel to the inside of a front plate of the casing. In this case, the mounting of the motor to the fan panel is performed by providing a motor support inwardly of the vertically disposed fan panel and setting the motor on the motor support so that output shaft of the motor is parallel to the surface of the fan panel.

Meanwhile, the motor is mounted to the surface of the vertically disposed fan panel with the motor support being interposed therebetween. Accordingly, if a drop accident occurs due to a certain cause during transport of the duct type air conditioner or the like, a large impact load is applied to the motor support or the fan panel by the weight of the motor 430, so that the motor support or the fan panel can be deformed with the result that there is a concern that the deviation of the output shaft of the motor is caused.

SUMMARY OF THE INVENTION

An object of the present invention is to provide a duct type air conditioner that prevents the deformation of a motor support or a fan panel even though a drop accident occurs due to a certain cause during transport or the like.

In order to achieve the above object, according to a first embodiment of the invention, there is provided a duct type air conditioner including at least: a casing having discharge openings and a suction opening therein; said casing being composed of a front plate formed with a discharge duct mounting frame outwardly thereof so as to surround said discharge openings; a fan mechanism mounted inwardly of said front plate; said casing being further composed of a back plate formed with a suction duct mounting frame outwardly thereof so as to surround the suction opening; a heat exchanger mounted inwardly of said back plate, a top plate covering an upper surface of said casing, and a bottom plate covering a lower surface of the casing. Said fan mechanism includes fan units having fan panels, motor supports mounted inwardly of said fan panels, motors mounted on said motor supports so that output shafts of the motors are parallel to the surfaces of the fan panels, fans positioned inwardly of said fan panels and driven by the motors, and spacers mounted to said motor supports so as to be positioned between the motor supports and the top plate or the bottom plate that serves as a bottom during conveyance.

According to a second embodiment of the invention, in the duct type air conditioner according to the first embodiment of the invention, said motor supports and said spacers include contact surfaces to come into contact with each other, said respective contact surfaces including positioning means for regulating positional deviation in an axial direction of the motor.

According to a third embodiment of the invention, in the duct type air conditioner according to the first or second embodiment of the invention, said positioning means includes protrusions having a predetermined shape respectively and formed on one of the motor support and the spacer, and said positioning means further includes holes formed at the other thereof and to which the protrusions are fitted.

According to a fourth embodiment of the invention, in the duct type air conditioner according to any one of the first to third embodiments of the invention, the discharge openings are substituted by the suction opening, the suction opening is substituted by the discharge openings, the discharge duct mounting frame is substituted by the suction duct mounting frame, and the suction duct mounting frame is substituted by the discharge duct mounting frame.

According to the embodiments of the invention, since spacers are mounted on spacer mounting surfaces of motor supports, the spacers are interposed between the motor supports and the top plate or bottom plate. Accordingly, the spacers and the top plate or the bottom plate receive impact loads. As a result, it is possible to prevent the motor supports or the fan panels from being deformed.

DETAILED DESCRIPTION OF THE EMBODIMENTS

Figure 1:
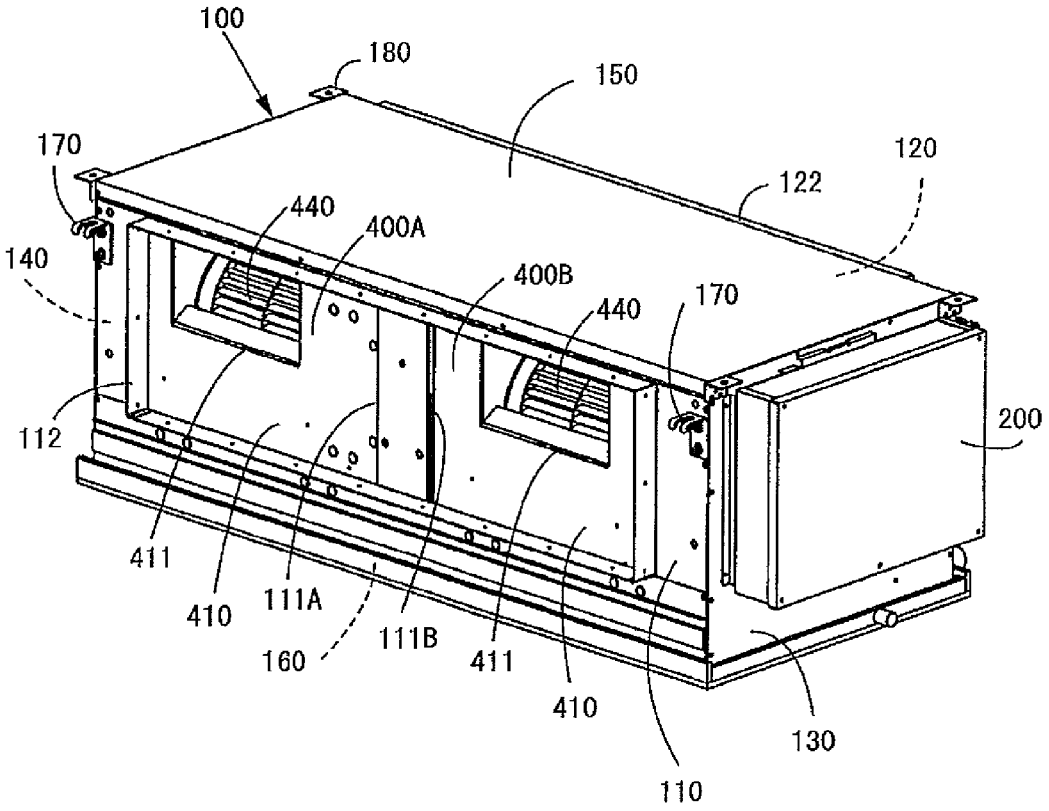
FIG. 1 is a perspective view of a duct type air conditioner according to an embodiment of the invention.

In FIG. 1, a casing 100 includes a front plate 110, a back plate 120, a right side plate 130 to mount an electric component box 200 thereonto, a left side plate 140, a top plate 150, and a bottom plate 160.

Figure 5:
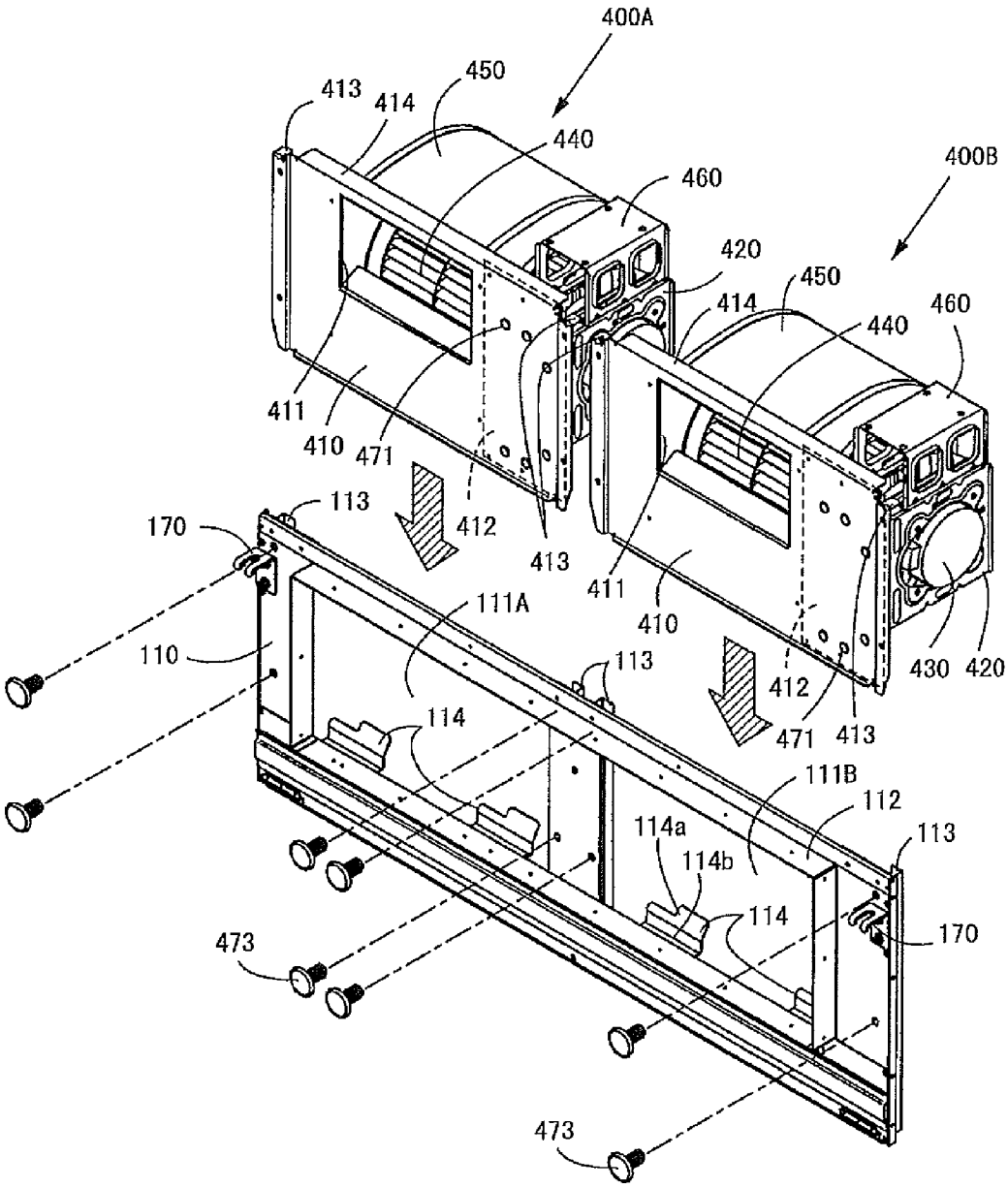
FIG. 5 is an exploded perspective view showing that the fan units are assembled with a front plate of the duct type air conditioner.

For example, as shown in FIG. 5, a discharge duct mounting frame 112 is mounted to the front plate 110 so as to integrally surround discharge openings 111A and 111B arranged so as to be spaced away from each other in a transverse direction. Hanging hooks 170 are attached to the front surface of the front plate 110 at both ends of the upper portion thereof. Further, a pair of vertical rails 113, which is bent in an L shape so that the inner portions thereof face each other, are provided on both sides of each of the discharge openings 111A and 111B inwardly of the front plate. Furthermore, panel retainers 114 are attached inwardly to the lower end of portions of each of the discharge openings 111A and 111B. Each of the panel retainers 114 includes an inclined surface portion 114*a* that is slightly opened inwardly and a stopper portion 114*b* that has the shape of a frame to form a bottom.

Figure 3:
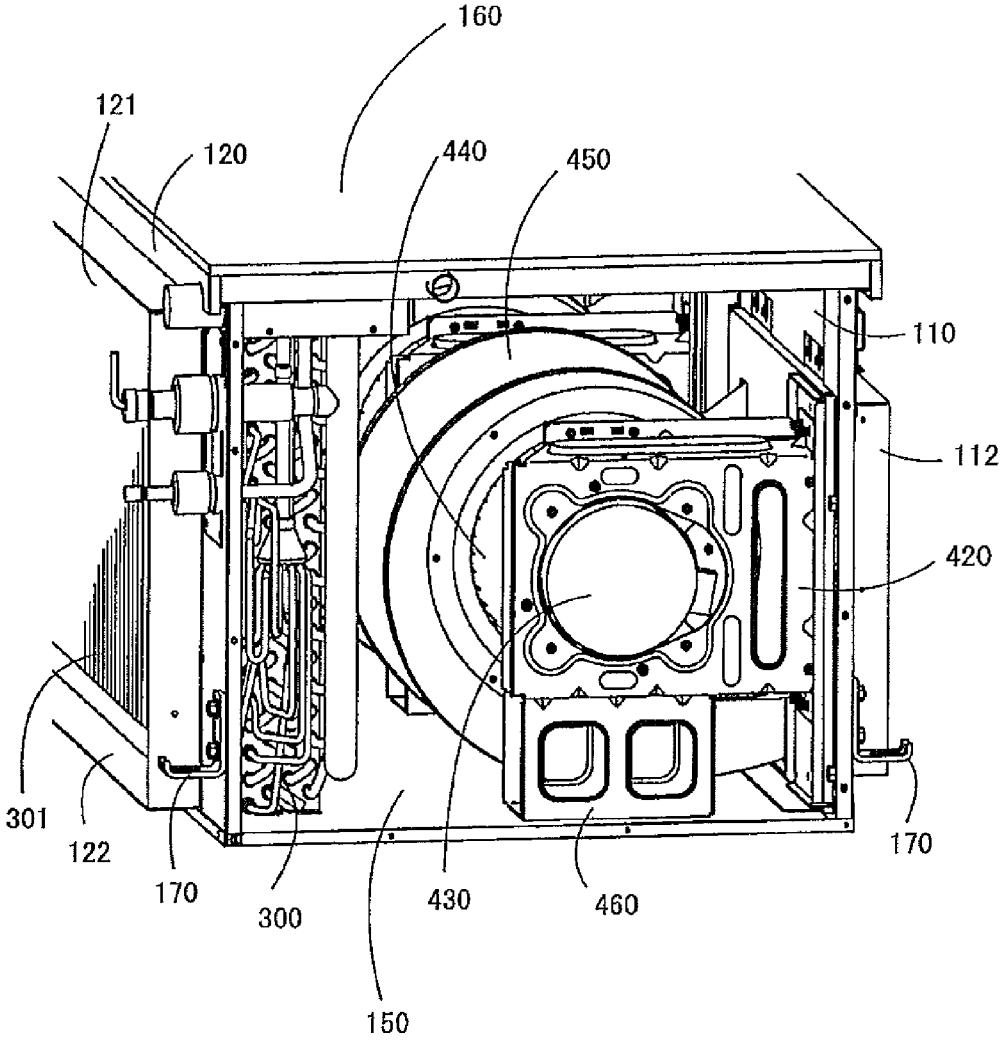
FIG. 3 is a partial perspective view of the duct type air conditioner from which a right side plate and an electric component box are removed and which is turned upside down.

For example, as shown in FIG. 3 showing the duct type air conditioner turned upside down, a suction duct mounting frame 122 is attached to the back plate 120 so as to surround a suction opening 121 through which a fin portion 301 of a heat exchanger 300 is exposed. Further, hanging hooks 170 are attached to the back plate 120 at both ends of the upper portion thereof (the lower portion in FIG. 3 showing the duct type air conditioner that is turned upside down).

Fan units 400A and 400B have the same structure and are independent of each other to forma fan mechanism. For example, as shown in FIGS. 2 to 5, each of the fan units 400A and 400B includes a fan panel 410, a motor support 420 mounted to the back surface of the fan panel 410, a DC motor 430 assembled with the motor support 420, a fan 440 that uses an output shaft of the DC motor 430 as a rotating shaft, a fan cover 450 that surrounds the fan 440 at portions other than where air is sucked and discharged, and a spacer 460 that is mounted on the motor support 420 to serve during the assembling and transport.

In the prior art, a partition plate is used for two fans 410 directly fixed thereto while in the present invention such two separate fan panels (divided fan panel) instead of the single partition plate are used for the separate fans. Each of the fan panels 410 includes a discharge port 411 formed at a position facing the fan 440, a reinforcing plate 412 attached to the inside of the fan panel beside the discharge port 411 in the transverse direction, press portions 413 bent inwardly from upper portions of both side ends of the fan panel 410, and a handle portion 414 as a handle bent inwardly of an upper end portion of the fan panel except for both side ends of the upper end portion. The discharge ports 411 have a size small enough to be positioned in the range of the discharge openings 111A and 111B of the front plate 110. The reinforcing plate 412 is to reinforce a portion of the corresponding fan panel 410, and the motor support 420 is attached to said reinforcing plate 412.

Figure 6:
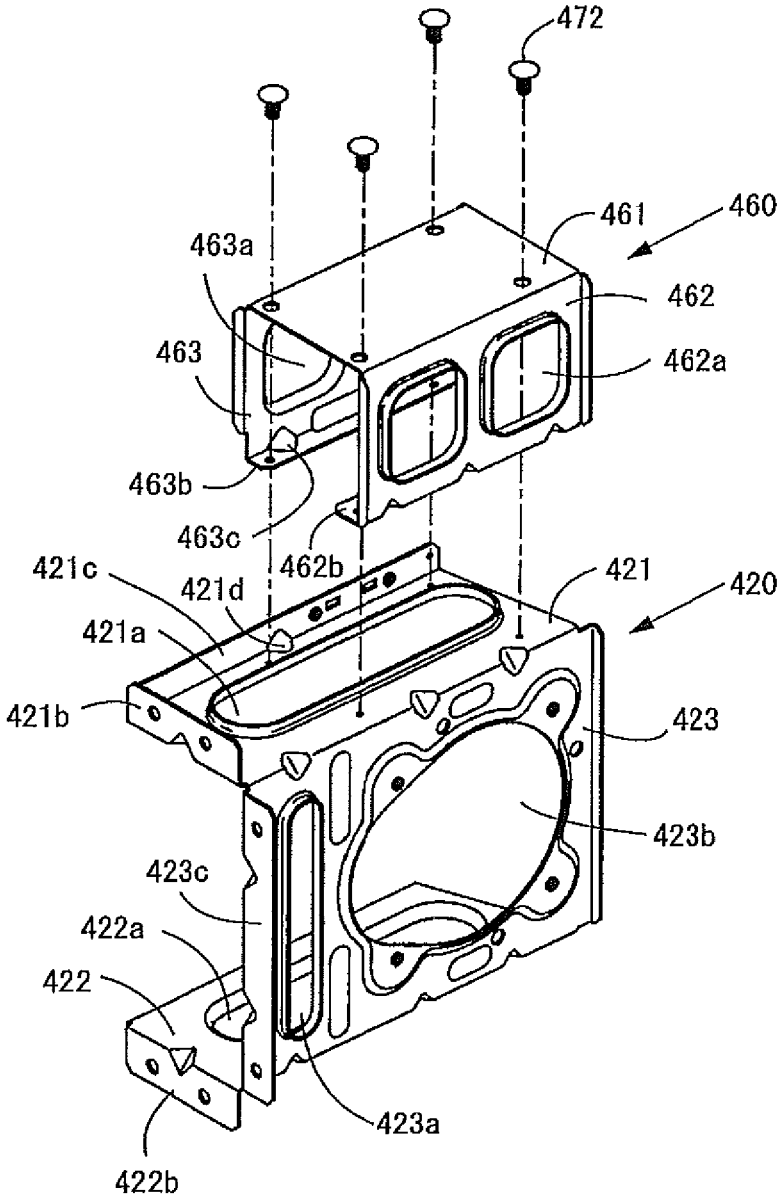
FIG. 6 is an exploded perspective view showing that a spacer is assembled with a motor supporting frame of the duct type air conditioner.

As shown in FIG. 6, the motor support 420 is formed by bending a metal plate into a U shape. The motor support includes a spacer mounting surface 421 on which the spacer 460 is mounted, a bottom portion 422, and a side portion 923. Air holes 421*a*, 422*a*, and 423*a* are formed respectively in the spacer mounting surface 421, the bottom portion 422, and the side portion 423 so as not to interrupt airflow generated by the fan 440. A mounting hole 423*b*, in order to mount the motor 430 therethrough, is formed in the side portion 423. In addition, mounting portions 421*b*, 422*b*, and 423*c*, which are to be fixed to the fan panel 410, are formed by bending common end portions of the spacer mounting surface 421, the bottom portion 422, and the side portion 423 outward. Further, reinforcing ribs are formed by bending the ends of the spacer mounting surface 421, the bottom portion 422, and the side portion 423 as well as the peripheries of the air holes. Furthermore, a substantially triangular pyramid-shaped protrusion 421*d* for positioning the spacer 460 is formed at the bent portion of the reinforcing rib 421*c* of the spacer mounting surface 421.

In order to mount the motor support 420 to the inside of the fan panel 410, the mounting portions 421*b*, 422*b*, and 423*c* are fixed on the reinforcing plate 412, which has already been attached to the inside of the fan panel 410 by screws 471. Accordingly, the motor support 420 is mounted on the inside of the fan panel 410 so as to protrude inwardly. When the motor 430 is mounted on the motor support 420, a large deformation load is applied to the fan panel 410. However, since the thickness of the portion of the fan panel 410 supporting the motor doubles due to the reinforcing plate 412, the fan panel can sufficiently bear the load.

The fan cover 450 is attached to the inside of the fan panel 410 by screws (not shown) so as not to interfere with the fan 440. A similar discharge port is formed in the fan cover 450 at a position corresponding to the discharge port 411 of the fan panel 410.

As shown in FIG. 6, the spacer 460 is formed by bending a metal plate into a U shape, and includes a top portion 461 and side portions 462 and 463 such that when the top plate 150 is mounted thereonto, the top portion 461 comes into abutment with said top plate. Air holes 462*a* and 463*a* are formed in both side portions 462 and 463 of the spacer 460 so as not to interrupt airflow generated by the fan 440. Further, mounting portions 462*b* and 463*b*, which are to be fixed to the spacer mounting surface 421 of the motor support 420, are formed by bending the lower ends of the both side portions 462 and 463 inwardly. Furthermore, a substantially triangular hole 463*c* is formed in the bent portion of the mounting portion 463*b* of the side portion 463 to give the spacer 460 the proper positions when the spacer 460 is to be mounted to the motor support 420.

In order to mount the spacer 460 to the motor support 420, the spacer and the motor support are completely positioned by fitting the protrusion 421*d* for positioning the spacer mounting surface 421 of the motor support 420 into the hole 463*c* for positioning the spacer 460. Then, as shown in FIG. 6, the mounting portions 462*b* and 463*b* of the spacer 460 are fixed to the spacer mounting surface 421 of the motor support 420 by screws 472.

As shown in FIG. 5, after being separately assembled in advance, the respective fan units 400A and 400B are mounted inwardly of the front plate 110 by manually holding the handle portion 414 of the fan panels 410 and lowering said respective fan units from above so that the both edges of the fan panels are guided by the vertical rails 113 formed inwardly of the front plate 110 to face each other.

Figure 2:
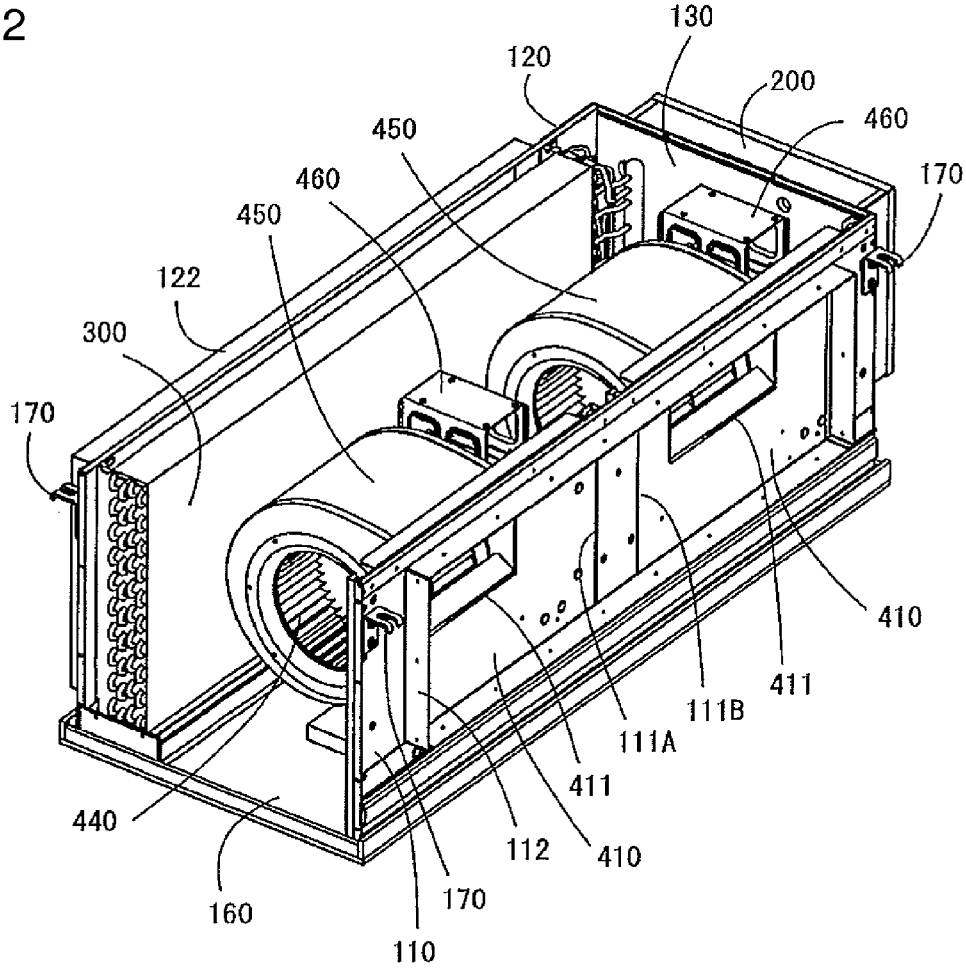
FIG. 2 is a perspective view of the duct type air conditioner from which a top plate and a left side plate are removed.
Figure 7:
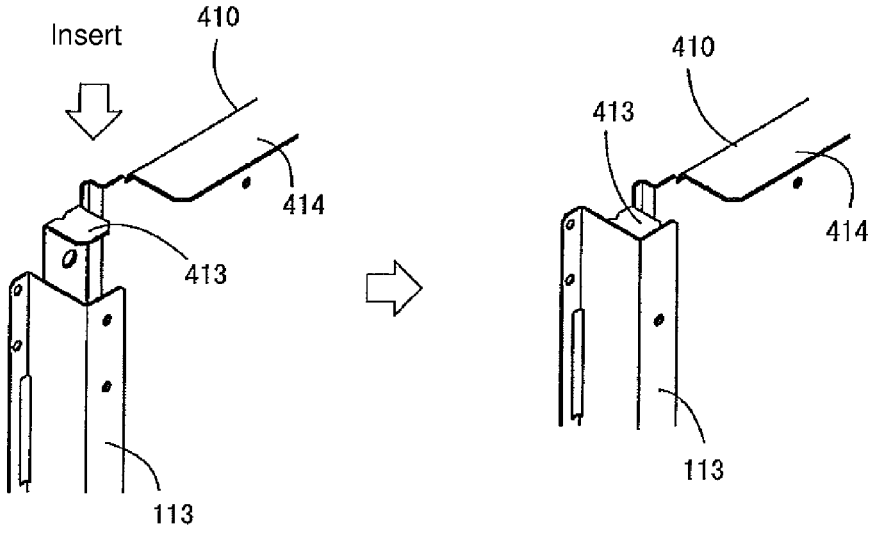
FIG. 7 is a view illustrating a mechanism for maintaining the posture of a fan panel of the duct type air conditioner.

In this case, the lower edge of each fan panel 410 rides the inclined surface portion 119*a* of the panel retainer 119 and slides forwardly while being guided downwardly to fit into the stopper portion 114*b*. Further, as shown in FIG. 7, the press portions 413, which are formed at both sides of the upper end of the fan panel 410, are pushed down into the vertical rails 113 such that the entire fan panel 410 is pressed against the front plate 110 provided forwardly thereof. Further, each of the fan panels 410 is fixed to the front plate 110 inwardly thereof by screws 473 such that the fan units 400A and 400B are assembled with the front plate 110. Therefore, as shown in FIGS. 1 and 2, the discharge ports 411 of the fan units 400A and 400B and the fans 440, which are provided in the casing, are exposed to the outside through the discharge openings 111A and 111B.

As described above, the fan mechanism requiring relatively heavy motors and formed of the fan units 400A and 400B that have the same structure are provided on two divided fan panels, respectively. Accordingly, the entire fan mechanism is downsized in comparison with a fan unit having the same air discharge performance with one motor and two fans, and the total weight of each of the fan units may thus be reduced by half. As a result, it is easier to handle and assemble the fan units. Further, a required die may be downsized such that initial investment can also be reduced. Furthermore, at the time of repair, the screws 473 used for a broken fan unit of the fan units 400A and 400B are removed and only a broken fan unit may be separated from the front plate 110 by manually holding the handle portion 414 with fingers to lift the broken fan unit. After the repair, it is also easy to perform a maintenance service.

In addition, when the lower edges of the fan panels 410 of the fan units 400A and 400B are inserted until coming into contact with the panel retainers 114 while the fan panels are guided by the vertical rails 113 from the upper side thereof formed on both sides of the front plate 110 and the press portion 413 of the fan panels 410 are then pushed down into the vertical rails 113, the fan units 400A and 400B are completely mounted on the inside of the front plate 110. Accordingly, it is easier to mount the fan units 400A and 400B on the inside of the front plate 110. Further, since the fan panel 410 is mounted at a regular position while being pressed against the inside of the front plate 110, screw holes of the front plate 110 naturally correspond to screw holes of the fan panels 410. As a result, screw insertion and tightening work is facilitated.

Figure 4:
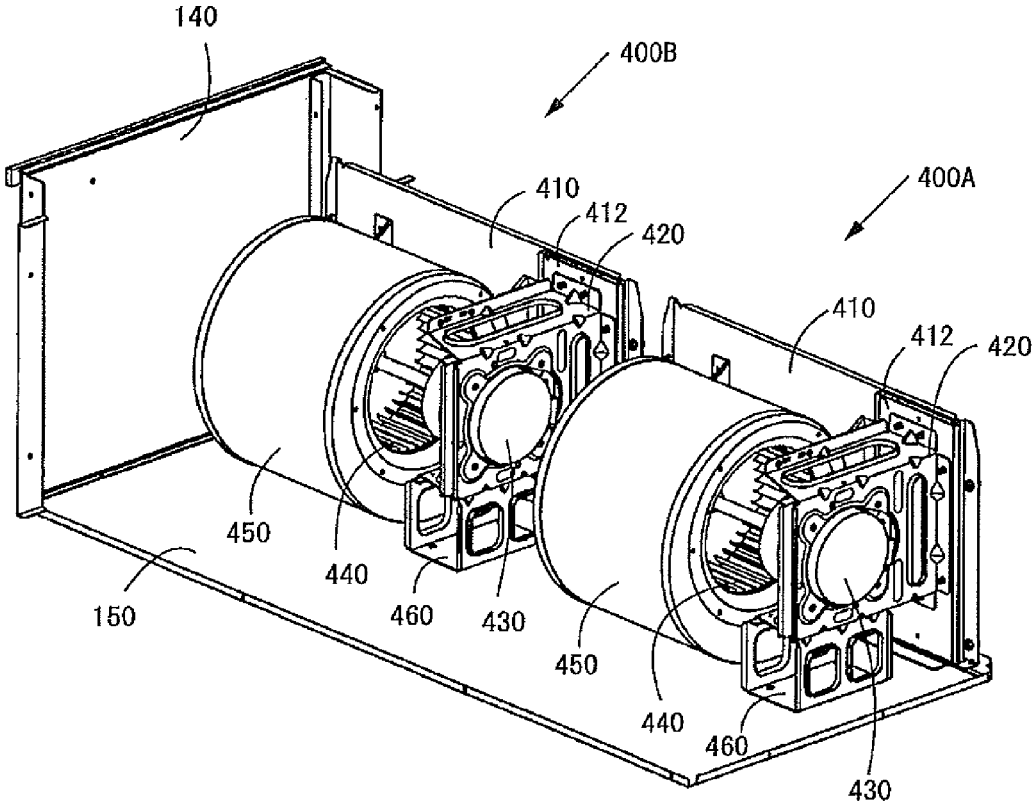
FIG. 4 is a perspective view of fan units provided in the duct type air conditioner and turned upside down.

Further, there are times when the duct type air conditioner is needed to be turned upside down at the time of assembling or conveyance after completion of the assembling operation. If, however, a drop accident occurs due to a certain cause when the duct type air conditioner is turned upside down, large impact loads are applied to the fan panels 410 by the weight of the motors 430 of the fan units 400A and 400B. In such a case, there is a risk of the motor supports or the fan panels 410 being deformed to cause deviation to occur in the shafts of the motors 430 and the fans 440. In this embodiment, since the spacers 460 are mounted on the spacer mounting surfaces 421 of the motor supports 920, the spacers 460 are interposed between the top plate 150 and the motor supports 420 as shown in FIG. 4. Accordingly, the spacers 460 and the top plate 150 bear the impact loads. As a result, it may be possible to prevent the motor supports or the fan panels 410 from being deformed and to prevent deviation in the shafts of the motors 430 and the fans 440.

Meanwhile, in the case the bottom plate 160 is to maintain the lower position by serving as a bottom even at the time of conveyance as at the time of installation, the motor and the fan are likewise completely protected even in a drop accident the spacer 460 is mounted on the surface of the motor support 420 facing the bottom plate 160 because the spacer 460 supports the motor support 420 against the bottom plate 160.

Further, in the above-mentioned embodiments, the heat exchange of the air sucked from the back plate 120 has been performed by the heat exchanger 300 through the operation of the fan units 400A and 400B and the air has then been discharged out of the front plate 110. However, the heat exchange of the air sucked from the front plate 110 may be performed by the heat exchanger 300 through the operation of the fan units 400A and 400B and the air may then be discharged out of the back plate 120. In this case, the discharge openings 111A and 111B serve as the suction opening 121 and the suction opening 121 serves as the discharge openings. Further, the discharge duct mounting frame 112 serves as the suction duct mounting frame, and the suction duct mounting frame 122 serves as the discharge duct mounting frame.

What is claimed is:

1. A duct type air conditioner comprising at least:

a casing, a fan unit having a fan panel mounted on a plate of the casing, a motor support mounted on said fan panel, a motor mounted on said motor support so that an output shaft of the motor is parallel to a surface of the fan panel, a fan driven by the motor, and a spacer mounted on said motor support, the spacer formed into U shape including side portions and a top portion which abuts the plate of the casing.

2. The duct type air conditioner according to claim 1, wherein said motor supports and said spacers include contact surfaces to come into contact with each other, said respective contact surfaces including positioning means for regulating positional deviation in an axial direction of the motor.

3. The duct type air conditioner according to claim 1, wherein the air flow is reversed through the air conditioner such that the discharge openings serves as the suction opening, the suction opening serves as the discharge openings, the discharge duct mounting frame serves as the suction duct mounting frame, and the suction duct mounting frame serves as the discharge duct mounting frame.

4. The duct type air conditioner according to claim 2, wherein said positioning means includes protrusions having a predetermined shape respectively and formed on one of the motor support and the spacer, and said positioning means further includes holes formed at the other thereof and to which the protrusions are fitted.

5. The duct type air conditioner according to claim 2, wherein the air flow is reversed through the air conditioner such that the discharge openings serves as the suction opening, the suction opening serves as the discharge openings, the discharge duct mounting frame serves as the suction duct mounting frame, and the suction duct mounting frame serves as the discharge duct mounting frame.

6. The duct type air conditioner according to claim 1, wherein the air flow is reversed through the air conditioner such that the discharge openings serves as the suction opening, the suction opening serves as the discharge openings, the discharge duct mounting frame serves as the suction duct mounting frame, and the suction duct mounting frame serves as the discharge duct mounting frame.

7. The duct type air conditioner according to claim 4, wherein the air flow is reversed through the air conditioner such that the discharge openings serves as the suction opening, the suction opening serves as the discharge openings, the discharge duct mounting frame serves as the suction duct mounting frame, and the suction duct mounting frame serves as the discharge duct mounting frame.

8. The duct type air conditioner according to claim 1, wherein the fan units comprises: reinforcing plates mounted inwardly of said fan panels; and the motor supports mounted to said reinforcing plates.

* * * * *